US007737101B2

(12) United States Patent
Thonhauser et al.

(10) Patent No.: US 7,737,101 B2
(45) Date of Patent: Jun. 15, 2010

(54) METHOD OF CLEANING AND DISINFECTING BEVERAGE DISPENSING SYSTEMS

(75) Inventors: Manfred Thonhauser, Perchtoldsdorf (AT); Christian Thonhauser, Vienna (AT)

(73) Assignee: Dipl. Ing. Thonhauser GmbH, Perchtoldsdorf (AT)

( * ) Notice: Subject to any disclaimer, the term of this patent is extended or adjusted under 35 U.S.C. 154(b) by 398 days.

(21) Appl. No.: 10/398,348

(22) PCT Filed: Jul. 26, 2001

(86) PCT No.: PCT/AT01/00258

§ 371 (c)(1),
(2), (4) Date: Apr. 4, 2003

(87) PCT Pub. No.: WO02/31098

PCT Pub. Date: Apr. 18, 2002

(65) Prior Publication Data

US 2004/0033930 A1 Feb. 19, 2004

(30) Foreign Application Priority Data

Oct. 13, 2000 (AT) ..... A 1757/2000

(51) Int. Cl.
*C11D 17/00* (2006.01)

(52) U.S. Cl. ..... 510/218; 510/311; 510/375; 510/392

(58) Field of Classification Search ..... 510/302, 510/311, 375, 380, 446, 379
See application file for complete search history.

(56) References Cited

U.S. PATENT DOCUMENTS

| | | | | |
|---|---|---|---|---|
| 3,677,953 | A | 7/1972 | George | |
| 4,683,072 | A * | 7/1987 | Holdt et al. | 510/192 |
| 6,140,299 | A * | 10/2000 | Eriksson | 510/376 |
| 6,306,641 | B1 * | 10/2001 | Horn et al. | 435/262.5 |
| 6,455,086 | B1 * | 9/2002 | Trinh et al. | 426/321 |

FOREIGN PATENT DOCUMENTS

| | | |
|---|---|---|
| GB | 1 510 452 | 5/1978 |
| WO | WO 98 42812 | 10/1998 |

OTHER PUBLICATIONS

*Dipling. Thonhauser GmbH* vs. *Norden Olje Aps*, Case No. FS9398/2009, Declaration by Mr. Wilfred Paul Worsley.
*Dipling. Thonhauser GmbH* vs. *Norden Olje Aps*, Case No. FS9398/2009, Respondent's Statement of Defense.

* cited by examiner

*Primary Examiner*—Necholus Ogden, Jr.
(74) *Attorney, Agent, or Firm*—Pillsbury Winthrop Shaw Pittman LLP

(57) ABSTRACT

A detergent and disinfectant in which water-soluble permanganates are used in an alkaline solution in order to initiate the oxidation of organic substances and simultaneously a chemical oxidant, preferably a peroxodisulfate, is used which is capable of producing radical reactions with catalytic support by manganates originating from the supplied permanganate, which reactions produce the oxidation of organic substances. All components are present in powder form and a respective powder mixture can be dissolved rapidly and free from residues in water. It thus represents a universally applicable, highly effective detergent and disinfectant.

32 Claims, 1 Drawing Sheet

Fig. 1: Relativ Stability (50% / 50%)
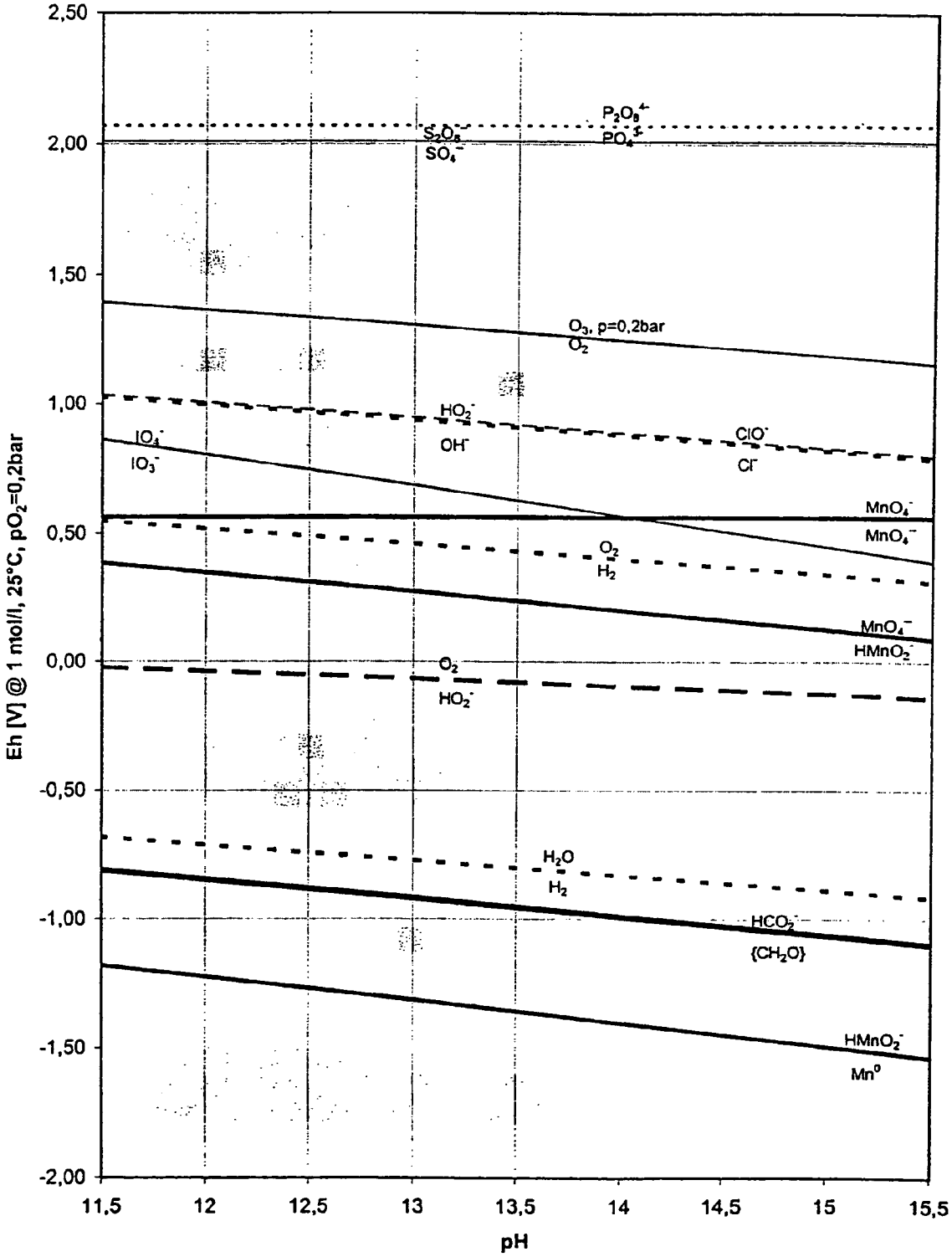

METHOD OF CLEANING AND DISINFECTING BEVERAGE DISPENSING SYSTEMS

CROSS REFERENCE TO RELATED APPLICATIONS

Applicant claims priority under 35 U.S.C. §119 of Austrian Application No. A 1757/2000, filed Oct. 13, 2000. Applicant also claims priority under 35 U.S.C. §365 of PCT/AT01/00258, filed Jul. 26, 2001. The international application under PCT article 21(2) was not published in English.

Chlorine is currently used especially for cleaning and disinfection. Compounds of chlorine such as hypochlorous acid (HOCl) or hydrochloric acid (HCl) are formed in a hydrous solution, on which in the end, together with the produced oxygen, the strongly oxidizing and therefore disinfecting effect of hydrous chlorine solutions is based. A similarly disinfecting effect is produced by the chloramines which arise during the reaction of chlorine with nitrogenous compounds, but which are felt by a number of people as being odorous and irritating to the eye. Critical side products of the disinfection with chlorine are finally chlorinated hydrocarbons. They occur in the reaction of chlorine with organic material and can be hazardous in higher concentrations. Efforts have therefore been undertaken regularly to replace chlorine by other chemicals for cleaning and disinfection without achieving the germicidal speed of chlorine.

A further problem in the use of chlorine for cleaning and disinfection is transport and storage, because special care must be observed in respective of this highly reactive substance.

The object of the present invention is thus a detergent and disinfectant which avoids such disadvantages while maintaining a similar oxidizing and disinfecting effect.

This is achieved in accordance with the invention by the characterizing features of claim 1.

Potassium permanganate ($KMnO_4$) is a strong oxidant whose germicidal effect has been known for a long time. In the strongly alkaline environment it is based in particular on the reduction of the heptavalent manganese to the oxidation number +6. For different reasons, however, the use in detergents and disinfectants was never achieved. Due to its strong oxidation effect, potassium permanganate proved to be incompatible with other necessary ingredients of a detergent for example. Furthermore, water acts as a reductive in the face of the high oxidation potential of potassium permanganate, thus leading to stability problems of the detergents in a hydrous solution.

GB 1 510 452 A discloses a detergent for toilet basins which consists of potassium permanganate and a sodium alkyl sulfate for reducing the surface tension. No further oxidants, especially in co-operation with potassium permanganate, are provided. The suitability of the agent must be doubted in general because no measures are undertaken in order to ensure the alkaline environment. Alkaline conditions, however, are necessary for preventing the precipitation of the manganese dioxide (Mn IV "brownstone") which shows a low water-solubility. Moreover, they promote the germicidal effect of the potassium permanganate.

In the present invention an oxidant is added to the permanganate whose oxidation potential exceeds that of the permanganate. In accordance with the invention this is achieved by adding peroxodisulfates, preferably sodium peroxodisulfate. As will be explained below in closer detail, radical reactions are initiated by their co-operation, as a result of which there is an efficient oxidation of organic substances.

As a result of the measures according to claim 5, an increase in the germicidal speed of the permanganate is achieved because the oxidation of organic compounds is accelerated under alkaline conditions.

Claim 6 ensures that the applied hardness stabilizers (complexing agents) are resistant to the peroxodisulfates. Moreover, a certain protective effect against the corrosion of non-ferrous metals and plastics can be assumed.

Claim 9 provides advantageous conditions for the transport and storage of a disinfectant and detergent as is the result of the method.

The reactions which are relevant for the efficiency of the detergent and disinfectant according to the invention are now described in detail by reference to a Pourbaix diagram (FIG. 1; for 25° C., 1 bar of atmospheric pressure and an electrolyte activity of 1 mol/L).

At first, a strong oxidant is provided in the form and concentration in accordance with the invention, which preferably concerns an alkali peroxodisulfate. Although the alkali peroxodisulfate is a strong oxidant, is reacts only slowly with organic compounds at room temperature and under the absence of respective catalysts. The efficient and complete oxidation of organic substances is rather initiated by the potassium permanganate. Organic carbon is oxidized into oxalate. For the purpose of accelerating the reaction kinetics between potassium permanganate and organic substances, an alkali hydroxide is added, preferably NaOH, in order to thus guarantee an alkaline environment.

In the application of the invention, the detergent and disinfectant which is present in powder form is dissolved at first quickly in water without any residues. As a result of the composition in accordance with the invention notice is taken that the dissolution of the hardness stabilizer occurs rapidly enough in order to prevent the precipitation of alkaline-earth carbonates and hydroxides as a result of the rising alkalinity of the solution, which is particularly decisive in the case of high water hardness. During the dissolution of the powder in accordance with the invention in water, there is at first the oxidation of hydroxide ions, namely by the peroxodisulfate (eq. 1) on the one hand, and also by the permanganate (eq. 2) on the other hand, with heptavalent manganese being reduced to manganese with oxidation number +6. A release of oxygen also occurs.

$$3OH^- + S_2O_8^{2-} = HO_2^- + 2SO_4^{2-} + H_2O \qquad \text{Eq. 1}$$

$$4OH^- + 4MnO_4^- = O_2\uparrow + 4MnO_4^{2-} + 2H_2O \qquad \text{Eq. 2}$$

The hydrogen peroxide ion arising during the oxidation of hydroxide ions by the peroxodisulfate can produce a reoxidation of the Mn(VI) to Mn(VII) (eq. 3):

$$HO_{2-} + 2MnO_4^{2-} + H_2O = 3OH^- + 2MnO_4^- \qquad \text{Eq. 3}$$

When the decomposition rate of the peroxodisulfate cannot keep up with that of the permanganate (e.g. because the decomposition of the permanganate is promoted by a high concentration and/or favorable oxidizability of the organic substance), an increased formation of Mn(VI) will occur. The dominance of the hexavalent manganese species leads to a green coloration of the solution, which is in contrast to the initial purple coloration produced by manganese VII. The oxidation of organic compounds (designated here with "$CH_2O$", which stands generally for carbon of oxidation number 0 and in particular for carbohydrate) into oxalate by Mn VII and the thus concomitant decomposition of the permanganate occurs rapidly, because the high pH value acts in an anionizing manner on numerous organic materials, which facilitates the attack of anionic oxidants. The oxidation of organic substances by Mn VII also involves $MnO_4^{3-}$, where manganese is present with the oxidation number +5 (eq. 4), but is oxidized again into hexavalent manganese by permanganate (eq. 5).

$$2\{CH_2O\}+3MnO_4^-+2H_2O=C_2O_4^{2-}+3MnO_4^{3-}+8H^+ \quad \text{Eq. 4}$$

$$MnO_4^{3-}+MnO_4^-=2MnO_4^{2-} \quad \text{Eq. 5}$$

The attack of the permanganate on organic substances according to eq. 4 does not lead to the high efficiency of the powder in accordance with the invention. The rapid and efficient oxidation of organic substances is rather produced by the now starting radical reactions. The starting point is an $SO_4^-$ radical which arises from the peroxodisulfate. This radical can be produced at first by homolytic cleavage of the peroxodisulfate (eq. 6) or by its reaction with organic compounds (eq. 7):

$$S_2O_8^{2-}=2SO_4^- \quad \text{Eq. 6}$$

$$2S_2O_8^{2-}+2\{CH_2O\}+2H_2O=2SO_4^{2-}+2SO_4^-+\{C^{+1}—R\}+4H^+ \quad \text{Eq. 7}$$

In equation 7, $\{C^{+1}—R\}$ designates a radical with carbon in the oxidation number +1, e.g. formally $\{H_2C_2O_3\}^{2-}$, in which there is a double bond between the carbon atoms. Compounds in bold print designate radicals or radical ions.

As is shown by examination results, the $SO_4^-$ seems to be produced primarily by the co-operation with existing manganese compounds. It may be assumed that manganese VI or manganese V compounds have a radical-forming effect on peroxodisulfate according to the reactions 8 and 9:

$$MnO_4^{2-}+C_2O_4^{2-}+2H_2O=MnO_4^{3-}+2CO_3^{2-}+4H^+ \quad \text{Eq. 8}$$

$$MnO_4^{3-}+S_2O_8^{2-}=MnO_4^{2-}+SO_4^{2-}+SO_4^- \quad \text{Eq. 9}$$

A cascade of radical reactions is initiated, of which only the most important will be mentioned below. Thus, the $SO_4^-$ radical produces the formation of OH radicals (eq. 10). This radical belongs, as is generally known, to the most reactive compounds and oxidizes organic substances (eq. 11). $SO_4^-$ radicals can subsequently be produced again (eq. 12):

$$SO_4^-+H_2O=HSO_4^-+OH. \quad \text{Eq. 10}$$

$$2OH.+2\{CH_2O\}+H_2O=2OH^-+\{C^{+1}—R\}+4H^+ \quad \text{Eq. 11}$$

$$\{C^{+1}—R\}+4S_2O_8^{2-}+H_2O=4SO_4^{2-}+4SO_4^-+C_2O_4^{2-}+4H^+ \quad \text{Eq. 12}$$

After its formation according to eq. 10, the hydroxide radical can also react with oxalate (eq. 13). The sulfate radical is produced again subsequently by the peroxodisulfate (eq. 14):

$$OH.+C_2O_4^{2-}=OH^-+C_2O_4^- \quad \text{Eq. 13}$$

$$C_2O_4^-+S_2O_8^{2-}+2H_2O=2CO_3^{2-}+SO_4^{2-}+SO_4^-+4H^+ \quad \text{Eq. 14}$$

An other reaction channel for the oxidation of organic compounds involves the sulfate radical itself. The sulfate radical oxidizes organic compounds (eq. 15) and can finally be re-supplied again by peroxodisulfate (eq. 16):

$$2SO_4^-+2\{CH_2O\}+H_2O=2SO_4^{2-}+\{C^{+1}—R\}+4H^+ \quad \text{Eq. 15}$$

$$\{C^{+1}—R\}+4S_2O_8^{2-}+H_2O=4SO_4^{2-}+4SO_4^-+C_2O_4^{2-}+4H^+ \quad \text{Eq. 16}$$

The sulfate radical can also react with oxalate (eq. 17), with the same being re-supplied again by means of a peroxodisulfate molecule (eq. 18):

$$SO_4^-+C_2O_4^{2-}=SO_4^{2-}+C_2O_4^- \quad \text{Eq. 17}$$

$$C_2O_4^-+S_2O_8^{2-}+2H_2O=2CO_3^{2-}+SO_4^{2-}+SO_4^-+4H^+ \quad \text{Eq. 18}$$

It can thus be seen that in the course of the progress of the reactions 10 to 18 an efficient oxidation of organic compounds occurs, which oxidation is efficient through initiation of the radicals and is initiated by manganese compounds of different oxidation number and is maintained by peroxodisulfate.

Recombination reactions between radicals finally bring the chain reactions 10 to 18 to a final stop (eq. 19 to 24):

$$SO_4^-+SO_4^-=S_2O_8^{2-} \quad \text{Eq. 19}$$

$$SO_4^-+OH.=HSO_5^- \text{ (unstable)} \quad \text{Eq. 20}$$

$$4SO_4^-+\{C^{+1}—R\}+H_2O=4SO_4^{2-}+C_2O_4^{2-}+4H^+ \quad \text{Eq. 21}$$

$$OH.+OH.=H_2O_2 \quad \text{Eq. 22}$$

$$4OH.+\{C^{+1}—R\}+H_2O=4OH^-+C_2O_4^{2-}+4H^+ \quad \text{Eq. 23}$$

$$3\{C^{+1}—R\}+3H_2O=C_2O_4^{2-}+4\{CH_2O\}+4OH^- \text{ (disproportionation of e.g. } \{H_2C_2O_3\}^{2-}) \quad \text{Eq. 24}$$

Since manganate (VI) acts thermodynamically unstable in water, a dominance of manganese II (eq. 25) occurs subsequently:

$$MnO_4^{2-}+H_2O=O_2\uparrow+HMnO_2^-+OH^- \quad \text{Eq. 25}$$

A yellow coloration of the solution shows the presence of managese(II) which forms oxalate complexes and thus also the essential completion of the cleaning and disinfection process.

During the entire progress of the chain reactions 10 to 25 there is a release of oxygen and hydrogen peroxide (eq. 1, 2, 16 and 25), which additionally supports the cleaning and disinfection process.

It is not necessary to exclusively use peroxodisulfate compounds as additional strong oxidants. Other oxidants whose oxidation potential exceeds that of manganese VII to manganese VI (line $MnO_4^-/MnO_4^{--}$ in the Pourbaix diagram of FIG. 1), and preferably that of $HO_2^-$ to $OH^-$ (line $HO_2^-/OH^-$ in the Pourbaix diagram of FIG. 1), are potential candidates. Periodate would also be suitable with respect to the line $MnO_4^-/MnO_4^{--}$, which ensures a re-oxidation of manganate V or VI into permanganate within the scope of a slightly modified chemism. Although the use of peroxodiphosphate and ozone is theoretically possible, it can hardly be realized from a technical viewpoint. Peroxodiphosphate is currently not available in larger quantities and ozone decomposes rapidly due to its high reactivity, as a result of which it does not seem to be suitable for commercial detergents and disinfectants. Although hypochlorite would be sufficiently stable in a hydrous solution, it would be necessary to ensure the electrochemical dominance of the reduction-oxidation pair $ClO^-/Cl^-$ for the formation of $HO_2^-$ ions even in the case of storage over longer periods of time.

All components of the detergent and disinfectant in accordance with the invention are present in powdery form, a fact which apart from the efficient and rapid oxidation of organic substances is extremely advantageous for storing and transporting the agent.

The following examples should document the versatility of the possibilities for use of the detergent and disinfectant and shall not be understood as being limiting in any way.

EXAMPLE 1

The detergent and disinfectant in accordance with the invention can be used especially appropriately for beverage dispensing systems. The respective powder mixture contains 58% NaOH (prilled), 27.10% potassium tripolyphosphate, 14.75% sodium peroxodisulfate and 0.15% potassium permanganate. The application occurs in a concentration of approx. 8 g of powdery product per liter, with the dissolution in water occurring rapidly and free from residues. The release of sulfate, hydroxide and other radicals as well as the alkalinity promote the cleaning and disinfection process. The color change from purple (dominance of the manganese (VII) species) to green (dominance of the manganese (VI) species) and finally to yellow (dominance of the manganese (II/IV)) allows a visual evaluation of the cleaning progress.

EXAMPLE 2

The detergent and disinfectant in accordance with the invention can also be used for cleaning bottles. Currently, soiled bottles are immersed in lye baths. These baths substantially contain NaOH and additives for reducing the surface tension and need to be heated to at least 70° C. in order to allow a cleaning process. With the detergent and disinfectant in accordance with the invention it is possible to also achieve the desired sterilization at room temperature, which reduces the required machinery and improves cost-effectiveness. The bottles are merely sprayed with a powder mixture in accordance with the invention which is dissolved in water or with the two components NaOH/potassium tripolyphosphate and peroxodisulfate/permanganate which are present in liquid form. Following an exposure time which can be optimized easily due to the change of color, the sterilized bottles are sprayed off with water.

EXAMPLE 3

Inorganic coatings in vegetable- or potato-processing plants or breweries are usually difficult to dissolve because they consist of a mixture of salts which cannot be dissolved very well either by mineral acids or in alkaline solutions. They concern potassium oxalates, magnesium ammonium phosphates or silicates. The detergent and disinfectant in accordance with the invention allows the near residue-free removal of such precipitations. A hydrous solution of approx. 10% is produced with the recipe in accordance with the invention and the surfaces to be cleaned are treated with the same. Following an exposure time of less than one hour the coatings can be rinsed off easily with water.

The invention clamed is:

1. A method of cleaning a beverage dispensing system, comprising obtaining a composition comprising a first oxidant comprising a water-souble permanganate, an alkaline agent, and a second oxidant whose oxidation potential exceeds that of a mixture containing 50 mol % manganese VII and 50 mol % manganese VI; said composition changes color upon contact during oxidation of an organic substance.

2. The method as claimed in claim 1, wherein the second oxidant comprises peroxodisulfates.

3. The method as claimed in claim 1, wherein the water-soluble permanganate comprises potassium permanganate.

4. The method as claimed claim in 1, wherein the alkaline agent comprises an alkali hydroxide.

5. The method as claimed claim in 1, further comprising an oxidation resistant polyphosphate.

6. The method as claimed claim in 1, wherein all components of the composition are present in powder form.

7. The method as claimed claim in 1, wherein 7 to 8 grams of the composition is dissolved per liter of the aqueous liquid.

8. The method as claimed in claim 1, wherein the composition comprises:

20%-35% of 50% KOH,

5%-25% of 50% potassium tripolyphosphate,

25%-35% of hypochlorite lye, and at least 0.01% $KMnO_4$.

9. The method as claimed in claim 8, wherein the composition is used in form of a 3% aqueous solution.

10. The method as claimed in claim 1, wherein the composition comprises:

58% NaOH,

27% potassium tripolyphosphate,

15% $Na_2S_2O_8$, and at least 0.01% $KMnO_4$.

11. The method as claimed in claim 1, wherein the composition comprises:

28% of 50% KOH,

15% of 50% potassium tripolyphosphate,

30% of hypochlorite lye, and at least 0.01% $KMnO_4$.

12. The method as claimed in claim 1, wherein said alkaline agent is formulated to secure an alkaline environment with a pH value of at least 12.

13. The method as in claim 1, wherein an oxidation potential of the at second oxidant exceeds that of a mixture containing 50 mol % H02- and 50 mol % OH—.

14. The method as in claim 4, wherein the alkali hydroxide comprise NaOH.

15. The method as in claim 5, wherein the oxidation resistant polyphosphate comprises potassium tripolyphosphate.

16. The method of claim 1, wherein the composition changes color on contact with the organic, wherein said color change allows a visual evaluation of an amount of the organic oxidized by the composition.

17. The method as claimed in claim 1, wherein the color change is from purple to a second color other than purple.

18. The method as claimed in claim 17, wherein the second color is green.

19. The method as claimed in claim 17, wherein the second color is yellow.

20. The method of claim 1, wherein the water-soluble permanganate reacts with the organic substance.

21. The method of claim 2, wherein the organic substance and the peroxodisulfate reacts with the organic substance.

22. The method as claimed in claim 1, wherein the organic substance, the second oxidant comprises peroxodisulfate, and both the water-soluble permanganate and the peroxodisulfate react with the organic substance.

23. The method as claimed in claim 1, wherein the second oxidant comprises a hypochlorite.

24. The method as claimed in claim 23, further comprising a peroxodisulfate.

25. The method of claim 1, wherein the alkaline agent has a composition configured to secure an alkaline environment with a pH value of at least 10.

26. The method of claim 1, wherein the obtained the color change is visually evaluated.

27. The method of claim 1, further comprising adding the composition in a form of a powder to water.

28. The method of claim 27, wherein the powder dissolves in the water free from a residue.

29. The method of claim 26, wherein the method is configured to monitor a cleaning progress during a cleaning operation.

30. The method of claim 29, wherein the cleaning operation comprises cleaning in a brewery.

31. The method of claim 26, wherein the method is configured to sterilize a container.

32. The method of claim 31, wherein the container is sterilized by spraying the container with the composition and spraying off the composition applied to the container with water.

* * * * *